US010025237B2

(12) United States Patent
Sunohara et al.

(10) Patent No.: US 10,025,237 B2
(45) Date of Patent: Jul. 17, 2018

(54) IMAGE FORMING APPARATUS AND RECORDING MEDIUM TRANSPORT APPARATUS

(71) Applicant: FUJI XEROX CO., LTD., Tokyo (JP)

(72) Inventors: Tsuyoshi Sunohara, Kanagawa (JP); Takahito Chiba, Kanagawa (JP); Hidehiko Yamaguchi, Kanagawa (JP); Hideki Moriya, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/456,768

(22) Filed: Mar. 13, 2017

(65) Prior Publication Data

US 2018/0067426 A1 Mar. 8, 2018

(30) Foreign Application Priority Data

Sep. 2, 2016 (JP) ..... 2016-172250

(51) Int. Cl.
*G03G 15/20* (2006.01)
*G03G 15/00* (2006.01)

(52) U.S. Cl.
CPC ..... *G03G 15/2028* (2013.01); *G03G 15/657* (2013.01)

(58) Field of Classification Search
CPC ..... G03G 15/657; G03G 15/2028; G03G 15/2085; G03G 2215/2045
USPC ..... 399/68, 400
See application file for complete search history.

(56) References Cited

U.S. PATENT DOCUMENTS

2005/0169683 A1* 8/2005 Tanaka ..... G03G 15/657 399/400
2015/0153689 A1* 6/2015 Russel ..... G03G 15/2028 399/68
2017/0008715 A1* 1/2017 Morino ..... G03G 15/657

FOREIGN PATENT DOCUMENTS

JP 05-281874 A 10/1993
JP 2003-285484 A 10/2003

* cited by examiner

*Primary Examiner* — Sophia S Chen
(74) *Attorney, Agent, or Firm* — Sughrue Mion, PLLC

(57) ABSTRACT

An image forming apparatus includes: a transport unit configured to pinch and transport a recording medium at a first transport speed, a fixing unit configured to fix an image formed on the recording medium while pinching and transporting the recording medium, which is transported by the transport unit, at a second transport speed, a driving unit configured to drive the fixing unit, a detector configured to detect a load of the driving unit, and a controller configured to perform a control to adjust a speed difference between the first transport speed and the second transport speed with respect to a subsequently transported recording medium when the load becomes larger than a reference value after a peak value of the load when the recording medium enters the fixing unit is detected by the detector.

17 Claims, 4 Drawing Sheets

IMAGE FORMING APPARATUS AND RECORDING MEDIUM TRANSPORT APPARATUS

CROSS-REFERENCE TO RELATED APPLICATIONS

This application is based on and claims priority under 35 USC 119 from Japanese Patent Application No. 2016-172250 filed Sep. 2, 2016.

BACKGROUND

Technical Field

The invention relates to an image forming apparatus and a recording medium transport apparatus.

SUMMARY

According to an aspect of the invention, an image forming apparatus includes a transport unit configured to pinch and transport a recording medium at a first transport speed, a fixing unit configured to fix an image formed on the recording medium while pinching and transporting the recording medium, which is transported by the transport unit, at a second transport speed, a driving unit configured to drive the fixing unit, a detector configured to detect a load of the driving unit, and a controller configured to perform a control to adjust a speed difference between the first transport speed and the second transport speed with respect to a subsequently transported recording medium when the load becomes larger than a reference value after a peak value of the load when the recording medium enters the fixing unit is detected by the detector.

BRIEF DESCRIPTION OF THE DRAWINGS

Exemplary embodiments of the present invention will be described in detail based on the following figures, wherein.

DETAILED DESCRIPTION

Figure 1:
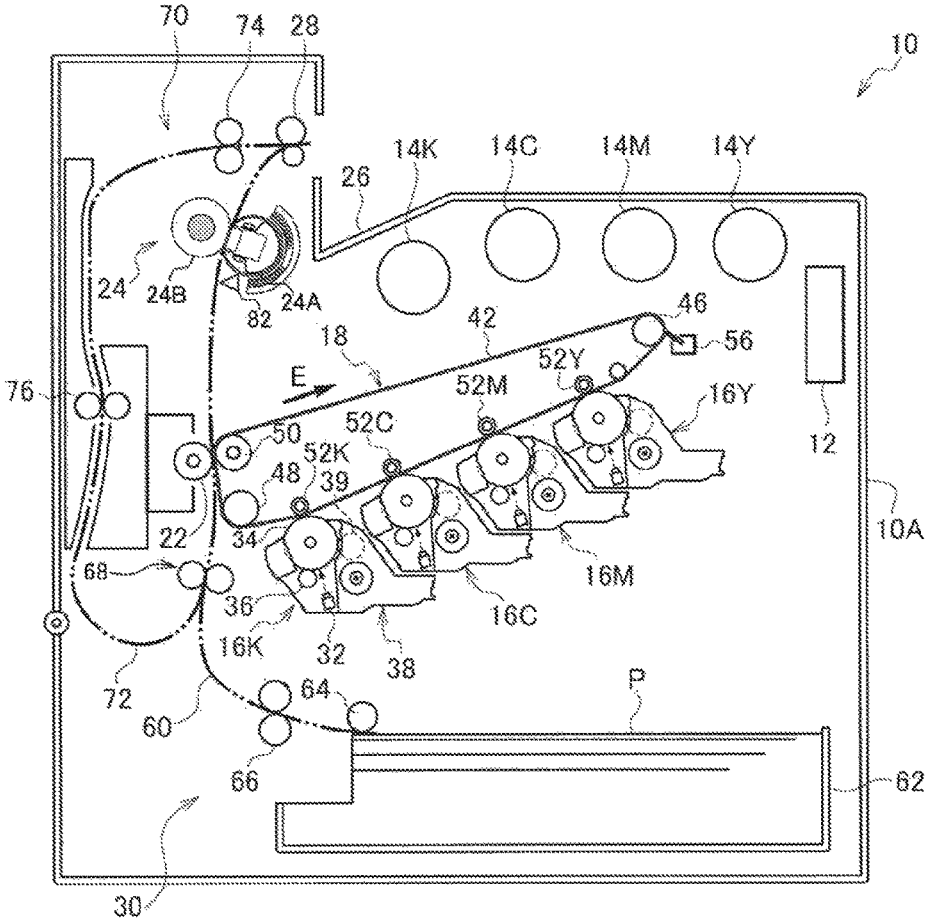
FIG. 1 is a sectional view illustrating a configuration of an image forming apparatus according to an exemplary embodiment.

Hereinafter, an exemplary embodiment for carrying out the invention will be described in detail with reference to the accompanying drawings.

A configuration of an image forming apparatus 10 according to the present exemplary embodiment will be described with reference to FIG. 1. Hereinafter, yellow will be represented by Y, magenta will be represented by M, cyan will be represented by C, and black will be represented by K. When it is necessary to distinguish respective constituent elements and toner images (images) from color to color, a color sign Y, M, C or K corresponding to each color will be added to the end of a reference number and descriptions will be made thereon. In addition, hereinafter, when the respective constituent elements and toner images are collectively called without distinguishing the constituent elements and toner images from color to color, a color sign will be omitted at the end of a reference numeral and descriptions will be made thereon.

(Overall Configuration)

As illustrated in FIG. 1, inside an apparatus main body 10A of an image forming apparatus 10, an image processing unit 12 is provided to perform an image processing of converting input image data into tone data of four colors of Y, M, C, and K.

In addition, at the center side of the apparatus main body 10A, image forming units 16 of respective colors, which respectively form toner images, are arranged to be spaced apart from each other in an inclined direction relative to the horizontal direction. In addition, at the vertically upper side of the image forming units 16 of respective colors, a primary transfer unit 18 is provided to which toner images formed in the image forming units 16 of respective colors are multiply transferred.

Further, at a lateral side (the left side of FIG. 1) of the primary transfer unit 18, a secondary transfer roller 22 is installed to transfer the toner images, which have been multiply transferred to the primary transfer unit 18, to a recording medium P transported along a transport path 60 by a supply transport unit 30 to be described below.

A fixing device 24 is installed at the downstream side of the secondary transfer roller 22 in the transport direction of the recording medium P (hereinafter simply referred to as a "transport direction"). The fixing device 24 fixes the toner images, which have been transferred to the recording medium P, to the recording medium P by heat and pressure.

In addition, at the downstream side with reference to the fixing device 24 in the transport direction, a discharge roller 28 is installed to discharge the recording medium P having the toner images fixed thereto to a discharge unit 26 provided in the upper portion of the apparatus main body 10A of the image forming apparatus 10.

Meanwhile, the supply transport unit 30 is installed at a vertically lower and lateral side of the image forming units 16 to supply and transport the recording medium P. In addition, at the vertically upper side of the primary transfer unit 18, four toner cartridges 14K to 14Y for respective colors are arranged side by side in the apparatus width direction. The toner cartridges 14K to 14Y are detachable from the apparatus main body 10A from the front side of the apparatus main body 10A and are filled with a toner to be replenished to a developing device 38 to be described below. The toner cartridges 14 of respective colors have a columnar shape extending in the apparatus depth direction. Each toner cartridge 14 is connected to corresponding one of the developing devices 38 of respective colors through a supply pipe (not illustrated).

(Image Forming Unit)

As illustrated in FIG. 1, all of the image forming units 16 of respective colors are configured to be substantially the same as each other. In addition, each image forming unit 16 according to the present exemplary embodiment includes a columnar image carrier 34 that rotates and a charging unit 36 that charges the surface of the image carrier 34.

In addition, the image forming unit 16 includes a light emitting diode (LED) head 32 that irradiates the surface of the charged image carrier 34 with exposure light that forms an electrostatic latent image. In addition, the image forming unit 16 includes the developing device 36 that develops an electrostatic latent image, which is formed via the irradiation of exposure light by the LED head 32, using a developer (in the present exemplary embodiment, a negatively charged toner) so as to visualize the electrostatic latent image as a toner image. In addition, the image forming unit 16 includes a cleaning blade (not illustrated) that cleans the surface of the image carrier 34.

A developing roller 39 is disposed in the developing device 38 to face the image carrier 34, and the developing device 38 develops an electrostatic latent image, which is formed on the image carrier 34, using the developing roller 39 and a developer to visualize the electrostatic latent image as a toner image.

In addition, the charging unit 36, the LED head 32, the developing roller 39, and the cleaning blade are arranged in this order from the upstream side to the downstream side of the image carrier 34 in the rotation direction (the counter-clockwise direction in the example of FIG. 1) to face the surface of the image carrier 34.

(Transfer Unit (Primary Transfer Unit and Secondary Transfer Roller))

The primary transfer unit 18 includes an endless intermediate transfer belt 42 and a driving roller 46. The intermediate transfer belt 42 is wound on the driving roller 46. The driving roller 46 is rotationally driven by a motor 112 (see FIG. 2) to circulate the intermediate transfer belt 42 in the direction indicated by the arrow E. In addition, the primary transfer unit 18 includes a tension imparting roller 48 and an auxiliary roller 50. The intermediate transfer belt 42 is wound on the tension imparting roller 48. The tension imparting roller 48 imparts tension to the intermediate transfer belt 42. The auxiliary roller 50 is disposed at the vertically upper side of the tension imparting roller 48 and is driven to rotate by the intermediate transfer belt 42. In addition, the primary transfer unit 18 includes primary transfer rollers 52, which are respectively located opposite to image carriers 34 of respective colors with the intermediate transfer belt 42 being interposed therebetween.

With this configuration, the toner images of respective colors of Y, M, C, and K, which are sequentially formed on the image carriers 34 of the image forming units 16 of respective colors, are multiply transferred to the intermediate transfer belt 42 by the primary transfer rollers 52 of respective colors.

In addition, a cleaning blade 56 is disposed opposite to the driving roller 46 with the intermediate transfer belt 42 being interposed therebetween to come in contact with the surface of the intermediate transfer belt 42 so as to clean the surface of the intermediate transfer belt 42.

In addition, the secondary transfer roller 22 is installed opposite to the auxiliary roller 50 with the intermediate transfer belt 42 being interposed therebetween to transfer the toner images, which have been transferred to the intermediate transfer belt 42, to the recording medium P that is being transported. The secondary transfer roller 22 is grounded, and the auxiliary roller 50 forms a counter electrode of the secondary transfer roller 22. When a secondary transfer voltage is applied to the auxiliary roller 50, the toner images are transferred to the recording medium P. At this time, the secondary transfer roller 22 and the intermediate transfer belt 42 are an exemplary transport unit that pinches and transports the recording medium P.

(Supply Transport Unit)

The supply transport unit 30 is disposed at the vertically lower side of the image forming units 16 within the apparatus main body 10A, and includes a paper feeding member 62 in which plural recording media P are loaded.

In addition, the supply transport unit 30 includes a Paper feeding roller 64 that sends out the recording media P, which is loaded in the paper feeding member 62, to the transport path 60, a separation roller 66 that separates the recording media P, which are sent out by the paper feeding roller 64, one by one, and a registration roller 68 that adjusts the transport timing of the recording media P. In addition, the respective rollers are arranged in this order from the upstream side to the downstream side of the transport direction.

With this configuration, the recording media P supplied from the paper feeding member 62 are sent out at a predetermined timing to a contact portion (secondary transfer position) between the intermediate transfer belt 12 and the secondary transfer roller 22 by the registration roller 68 that rotates.

The fixing device 24 according to the present exemplary embodiment includes a heating belt 24A and a pressure roller 24B. The fixing device 24 is a so-called induction heating (IH) fixing device that causes the heating belt 24A to generate heat using electromagnetic induction. In addition, the pressure roller 24B is driven (rotated) by a motor 122 (see FIG. 2), which is an exemplary driving unit. The heating belt 24A is driven to rotate according to the rotation of the pressure roller 24B.

With the above configuration, the recording medium P transported to the fixing device 24 is heated and pressurized by the fixing device 24 so that a toner image is fixed to one surface (image formation surface) of the recording medium P. Here, the fixing device 24 is an exemplary fixing unit that fixes an image formed on the recording medium P while pinching and transporting the recording medium P that is being transported by the secondary transfer roller 22 and the intermediate transfer belt 42.

In addition, the supply transport unit 30 includes a duplex transport device 70. For a recording medium P having a toner image fixed to one surface thereof by the fixing device 24, the duplex transport device 70 is used to form a toner image on the other surface of the recording medium P, rather than directly discharging the recording medium P to the discharge unit 26 by the discharge roller 28.

The duplex transport device 70 includes a duplex transport path 72 and transport rollers 74 and 76. In the duplex transport path 72, the record sing medium P is reversed and transported from the discharge roller 28 toward the registration roller 68. The transport rollers 74 and 76 transport the recording medium P along the duplex transport path 172.

(Others)

The image forming apparatus 10 includes a medium detection sensor 82 installed at the upstream side of the fixing device 24 along the transport path 60. The medium detection sensor 82 according to the present exemplary embodiment is, for example, a reflective sensor that includes a set of a light emitting element and a light receiving element. The medium detection sensor 82 irradiates from the light emitting element to a detection position on the transport path 60 which corresponds to the installation position thereof. In addition, the medium detection sensor 82 outputs a signal (hereinafter, referred to as a "detection signal") of the signal level according to the quantity of light received from the light receiving element. During the period for which the recording medium P passes the detection position, the light irradiated from the light emitting element is reflected by the recording medium P. Thus, detection signals output from the medium detection sensor 82 during the period for which the recording medium P passes the detection position are different in signal level from those output from the medium detection sensor 82 during the period for which the recording medium P does not pass the detection position.

In this way, the present exemplary embodiment employs the reflective sensor as the medium detection sensor 82. It should be noted that the medium detection sensor 82 is not limited thereto, but may be other sensors such as, for example, a transmissive sensor.

(Image Forming Process)

First, tone data of respective colors are sequentially output from the image processing unit 12 to LED heads 32 of respective colors. Then, by the LED heads 32, exposure lights according to the input tone data are emitted. The surfaces of the image carriers 34 charged by the charging units 36 are irradiated with the exposure lights that are emitted from the LED heads 32, respectively. Thus, electrostatic latent images are formed on the surfaces of the image carriers 34. The electrostatic latent images formed on the image carriers 34 are developed by the developing devices 38 of respective colors, respectively, and are visualized as toner images of respective colors of Y, M, C, and K, respectively.

In addition, the toner images of respective colors formed on the image carriers 34 are multiply transferred to the circulating intermediate transfer belt 42 by the primary transfer rollers 52 of the primary transfer unit 18.

The toner images of respective colors, which have been multiply transferred to the intermediate transfer belt 42, are secondarily transferred to the recording medium P at secondary transfer position by the secondary transfer roller 22 when the recording medium P has been transported to the secondary transfer position along the transport path 60 from the paper feeding member 62 by the paper feeding roller 64, the separation roller 66, and the registration roller 68.

In addition, the recording medium P, to which the toner image has been transferred, is transported to the fixing device 24. In addition, the toner image is fixed to the recording medium P by the fixing device 24. Then, the recording medium P, to which the toner image has been fixed, is discharged to the discharge unit 26 by the discharge roller 28.

Meanwhile, when forming images on the opposite sides of recording medium P, the recording medium P, to one surface (front surface) of which the toner image has been fixed by the fixing device 24, is not directly discharged to the discharge unit 26 by the discharge roller 28. In this case, the transport direction of the recording medium P is switched by reversely rotating the discharge roller 28. Then, the recording medium P is transported along the duplex transport path 72 by the transport rollers 74 and 76.

The recording medium P transported along the duplex transport path 72 is reversed and transported again to the registration roller 68. Then, after a toner image is transferred and fixed to the other surface (back surface) of the recording medium P, the recording medium P is discharged to the discharge unit 26 by the discharge roller 28.

Next, a configuration of main parts of an electrical system in the image forming apparatus 10 according to the present exemplary embodiment will be described with reference to FIG. 2.

Figure 2:
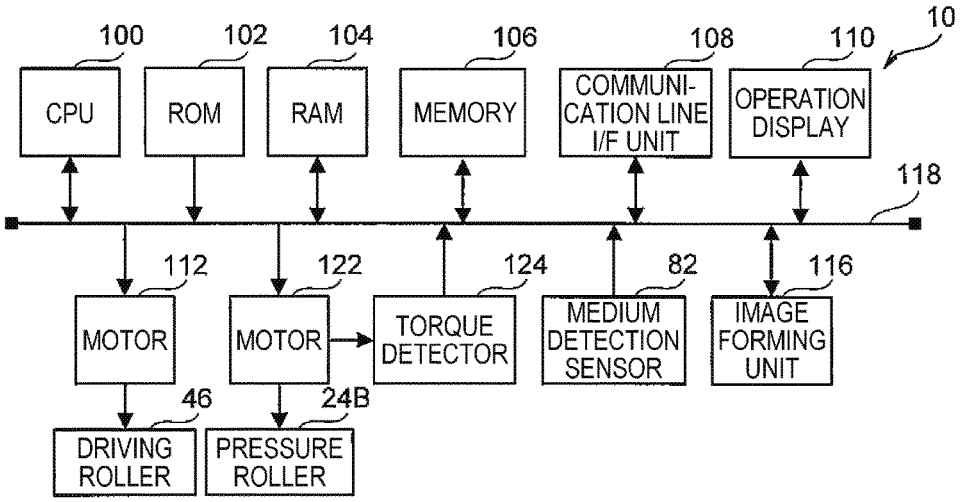
FIG. 2 is a block diagram illustrating a configuration of main parts of an electrical system in the image forming apparatus according to an exemplary embodiment.

As illustrated in FIG. 2, the image forming apparatus 10 according to the present exemplary embodiment includes a central processing unit (CPU) 100 that controls the overall operation of the image forming apparatus 10, and a read only memory (ROM) 102 that stores various programs or various parameters and the like in advance. In addition, the image forming apparatus 10 includes a random access memory (RAM) 104 to be used as a working area and the like when various programs are executed by the CPU 100, and a nonvolatile memory 106 such as a flash memory.

In addition, the image forming apparatus 10 includes a communication line interface (I/F) unit 108 that performs transmission and reception of communication data to and from an external device. In addition, the image forming apparatus includes an operation display 110 that receives an instruction with respect to the image forming apparatus 10 from a user and displays various information about the operation situation of the image forming apparatus 10 and the like to the user. In addition, the operation display 110 includes, for example, a display button that realizes reception of an operation instruction via execution of a program, a display provided with a touch panel on a display surface on which various information are displayed, and hardware keys such as a numeric keypad or a start button.

In addition, the image forming apparatus 10 includes a torque detector 124, which is an exemplary detector that detects the load (torque) of the motor 122, which is driven to rotate the pressure roller 24B. The torque detector 124 according to the present exemplary embodiment is connected to the motor 122, and detects the torque of the motor 122 as a value of a current that flows to the motor 122.

In addition, a configuration of the torque detector 124 according to the present exemplary embodiment is not specifically limited so long as it can detect the torque of the motor 122. For example, as the torque detector 124, a configuration in which the current value is detected by measuring a voltage value across a shunt resistor may be used. In addition, for example, as the torque detector 124, a configuration in which resistors are install ed on a path along which current flows to the motor 122 and a voltage value between the resistors is measured to detect a current value may be applied. In addition, for example, as the torque detector 124, a configuration in which a current sensor using a Hall element is installed on a path along which current flows to the motor 122 to detect a current value may be applied. In addition, the torque detector 124 may be configured to convert the detected current value into a voltage value and to output the voltage value. In addition, for example, as the torque detector 124, a torque detection detector that detects the torque of the motor 122 may be applied.

In addition, the image forming apparatus 10 is provided with an image forming unit 116 that includes constituent parts that perform various processing related to image formation on the recording medium P such as the image forming unit 16 and the primary transfer unit 18 described above. In addition, respective parts of the CPU 100, the ROM 102, the RAM 104, the memory 106, the communication line I/F unit 108, the operation display 110, the motor 112, the motor 122, the torque detector 124, the image forming unit 116, and the medium detection sensor 82 are connected to one another via buses 118 such as an address bus, a data bus, and a control bus.

With the above configuration, the image forming apparatus 10 according to the present exemplary embodiment performs, by the CPU 100, access to the ROM 102, the RAM 104, and the memory 106, and transmission and reception of communication data to and from an external device via the communication line I/F unit 108. In addition, the image forming apparatus 10 performs, by the CPU 100, acquisition of various instruction information via the operation display 110 and display of various information with respect to the operation display 110. In addition, the image forming apparatus 10 controls the rotation speed of the driving roller 46, that is, the transport speed (hereinafter, referred to as a "first transport speed") of the recording medium P by the secondary transfer roller 22 and the intermediate transfer belt 42 by controlling the motor 112 using the CPU 100.

In addition, the image forming apparatus 10 controls the rotation speed of the pressure roller 24B, that is, the transport speed (hereinafter, referred to as a "second transport speed") of the recording medium P by the fixing device 24 by controlling the motor 122 using the CPU 100. In addition, the image forming apparatus 10 performs, by the CPU 100, acquisition of a current value output from the torque detector 124 and control of the image forming unit 116.

In addition, the image forming apparatus 10 acquires, by the CPU 100, a detection signal output from the medium detection sensor 82. Thus, the image forming apparatus 10, by the CPU 100, detects whether or not the recording medium P passes a detection position using the medium detection sensor 82 based on the signal level of the acquired detection signal.

In the image forming apparatus 10 according to the present exemplary embodiment, the current value detected by the torque detector 124 largely varies when the recording medium P enters the fixing device 24 or is discharged from the fixing device 24.

Figure 3:
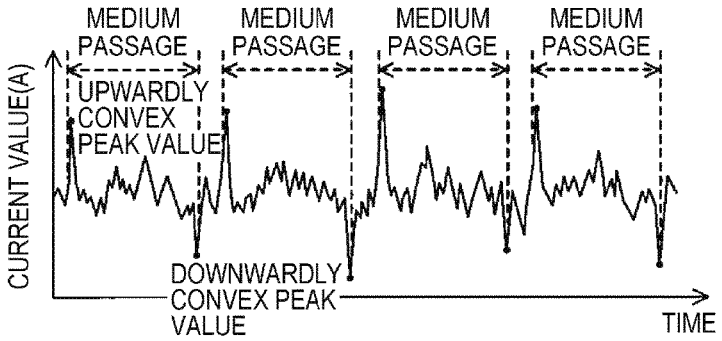
FIG. 3 is a graph illustrating exemplary time series data of detection results by a torque detector.

As an example, as illustrated in FIG. 3, when the recording medium P enters the fixing device 24, the current value increases and becomes a peak value that is convex (upwardly convex in the example illustrated in FIG. 3) toward the side at which the current value is large (the side at which the load is large). In addition, when the recording medium P is discharged from the fixing device 24, the current value decreases and becomes a peak value that is convex (downwardly convex in the example illustrated in FIG. 3) toward the side at which the current value is small (the side at which the load is small). Here, the vertical axis in FIG. 3 represents the current value detected by the torque detector 124, and the horizontal axis in FIG. 3 represents the time. In addition, hereinafter, although an example in which the maximum value, which is the top, or the minimum value, which is the bottom, is applied as the peak value will be described, the invention is not limited thereto. For example, a value, which is near and smaller than the maximum value, or a value, which is near and larger than the minimum value, may be applied as the peak value, and may be included in the peak value described in the present exemplary embodiment.

Meanwhile, in the image forming apparatus 10 according to the present exemplary embodiment, the motor 112 and the motor 122 are controlled in such a manner that the first transport speed is faster than the second transport speed by predetermined speed difference. Thus, as an example, as a result of the recording medium P being bent by a predetermined bending amount (so-called a loop amount) as represented by the solid line in FIG. 4, an image quality defect in which is caused in an image formed on the recording medium P due to a fixing process, is suppressed. Meanwhile, hereinafter, the speed difference between the first transport speed and the second transport speed means a speed difference based on the second transport speed, that is, a value acquired by subtracting the first transport speed from the second transport speed.

However, even if the motor 112 and the motor 122 are controlled as described above, the speed difference between the first transport speed and the second transport speed may not become a predetermined speed difference due to environmental conditions such as the kind of the recording medium P, temperature, and humidity, and the state changes of respective constituent elements of the image forming apparatus 10 due to the aging.

Figure 4:
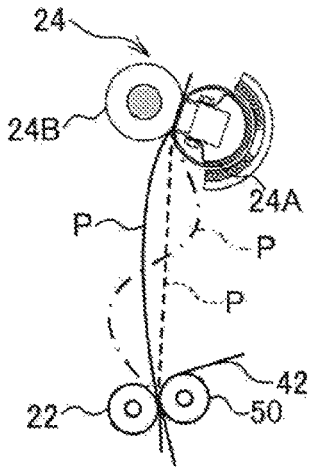
FIG. 4 is a partially enlarged view of the image forming apparatus used for description of a loop amount of a recording medium.

In the case where the speed difference between the first transport speed and the second transport speed is larger than the predetermined speed difference, that is, in the case where the second transport speed is excessively faster than the first transport speed, as indicated by the dashed line in FIG. 4 the loop amount of the recording medium P is reduced. In addition, in the case where the speed difference between the first transport speed and the second transport speed is smaller than the predetermined speed difference, that is, in the case where the second transport speed is excessively slower than the first transport speed, the loop amount of the recording medium P is increased as indicated by the one-dot dashed line in FIG. 4.

Subsequently, the change of the current value, which is detected by the torque detector 124 in the case where the speed difference between the first transport speed and the second transport speed is larger than the predetermined speed difference, will be described with reference to FIG. 5. At this time, a time t1 in FIG. 5 indicates the time when the current value after the peak value of the current value when the recording medium P enters the fixing device 24 is detected by the torque detector 124 is reduced to a predetermined value. In addition, a time t2 in FIG. 5 indicates the time when the trailing end portion of the recording medium P in the transport direction is discharged from the secondary transfer roller 22 and the intermediate transfer belt 42. In addition, time t3 in FIG. 5 indicates the time when the current value before the peak value of the current value when the recording medium P is discharged from the fixing device 24 is detected by the torque detector 124 is a predetermined value.

In addition, hereinafter, the period from the time t1 to the time t2 will be referred to as the period A, and the period from the time t2 to the time t3 will be referred to as the period B. That is, the period A is the period for which the recording medium P is transported by both of the secondary transfer roller 22 and the intermediate transfer belt 42 and the fixing device 24. In addition, the period B is the period for which the recording medium P is transported by the fixing device 24 among the secondary transfer roller 22, the intermediate transfer belt 42, and the fixing device 24.

Figure 5:
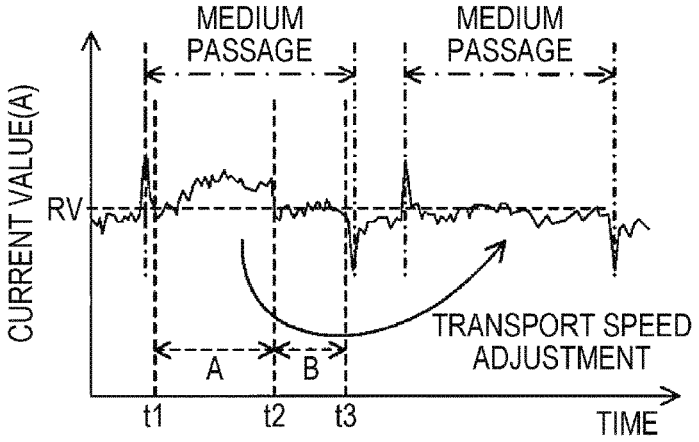
FIG. 5 is a graph illustrating exemplary time series data of detection results by the torque detector in the case where a second transport speed is excessively faster than a first transport speed.

As an example, as illustrated in FIG. 5, in the case where the speed difference between the first transport speed and the second transport speed is larger than the predetermined speed difference, the current value in the period A becomes larger than a reference value RV. This is because the fixing device 24 is affected by the resistance by the secondary transfer roller 22 and the intermediate transfer belt 42 via the recording medium P. In addition, in the present exemplary embodiment, descriptions are made with reference to the case where the average value of the current values in the period B is applied as the reference value RV, but is not limited thereto. For example, as the reference value RV, the median value of the current value in the period B and a fixed value, which has been previously obtained as a suitable value through a test and the like may be applied.

Subsequently, the change of the current value, which is detected by the torque detector 124 in the case where the speed difference between the first transport speed and the second transport speed is smaller than the predetermined speed difference, will be described with reference to FIG. 6. At this time, the time t1 to the time t3 in FIG. 6 are the same as the time t1 to the time t3 in FIG. 5.

Figure 6:
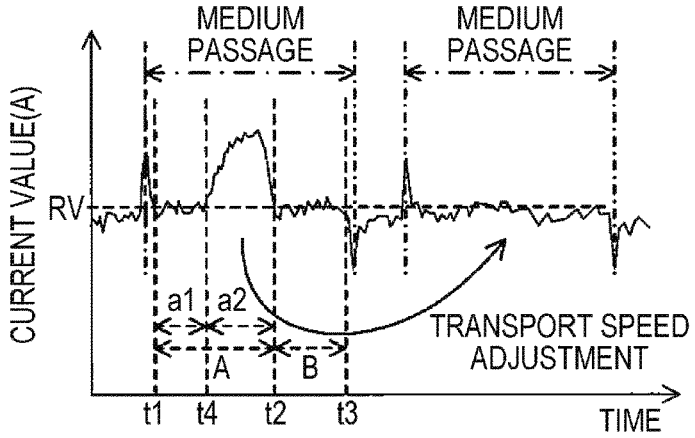
FIG. 6 is a graph illustrating exemplary time series data of detection results by the torque detector in the case where the second transport speed is excessively slower than the first transport speed.

As an example, as illustrated in FIG. 6, in the case where the speed difference between the first transport speed and the second transport speed is smaller than the predetermined speed difference, the current value in the period A becomes larger than the reference value RV after the time t4. This is because the fixing device 24 is affected by the resistance caused when the recording medium P comes into contact with, for example, an inlet chute unit and a coil bobbin of the fixing device 24, which are not illustrated. In addition, hereinafter, among the period A, the period from the time t1 to the time t4 is referred to as the period a1, and the period from the time t4 to the time t2 is referred to as the period a2. Here, as the time t4, the time, which is acquired via, for example, a test using an actual appliance of the image forming apparatus 10, as the time when the current value starts to rise to be larger than the reference value RV in the case where the speed difference between the first transport speed and the second transport speed is smaller than the predetermined speed difference, may be applied.

Thus, in the image forming apparatus 10 according to the present exemplary embodiment, in the case where the current value in the period A after the peak value of the current value when the recording medium P enters the fixing device 24 is detected by the torque detector 124 is larger than the reference value RV, the speed difference between the first transport speed and the second transport speed of the subsequently transported recording medium P is adjusted.

Specifically, before the period a1 has elapsed, that is, when the current value in the period a1 is larger than the reference value RV, the image forming apparatus 10 causes the second transport speed of the subsequently transported recording medium P to be slower than the current second transport speed. In addition, in this case, based on the following Table 1, the image forming apparatus 10 increases the degree of making the second transport speed is made slower as the length of the recording medium P in the transport direction (in Table 1, the size of the recording medium P is indicated) increases and the average value of the current values in the period A increases.

TABLE 1

| Current | Size | | |
|---|---|---|---|
| Value | Small | Medium | Large |
| A4 | 1% | 3% | 5% |
| A3 | 3% | 5% | 7% |

As shown in Table 1, the image forming apparatus 10 according to the present exemplary embodiment classifies the average value of the current values in the period A into three levels of small, medium, and large. In addition, the image forming apparatus 10 makes the second transport speed slower than the current second transport speed by a proportion shown in Table 1 in accordance with the combination of the size of the recording medium P and the average value of the current values. For example, in the case where the size of the recording medium P is A4 and the average value of the current values is small, the image forming apparatus 10 makes the second transport slower than the current second transport speed by 1%.

In addition, after the period a1 has expired, that is, when the current value in the period a2 becomes larger than the reference value RV, the image forming apparatus 10 causes the second transport speed of the subsequently transported recording medium P to be faster than the current second transport speed. In addition, in this case, based on Table 1, the image forming apparatus 10 increases the degree of making the second transport speed faster as the length of the recording medium P in the transport direction increases and the average value of the current values in period a2 increases. For example, in the case where the size of the recording medium P is A4 and the average value of the current values is small, the image forming apparatus 10 causes the second transport speed to be faster than the current second transport speed by 1%.

Figure 7:
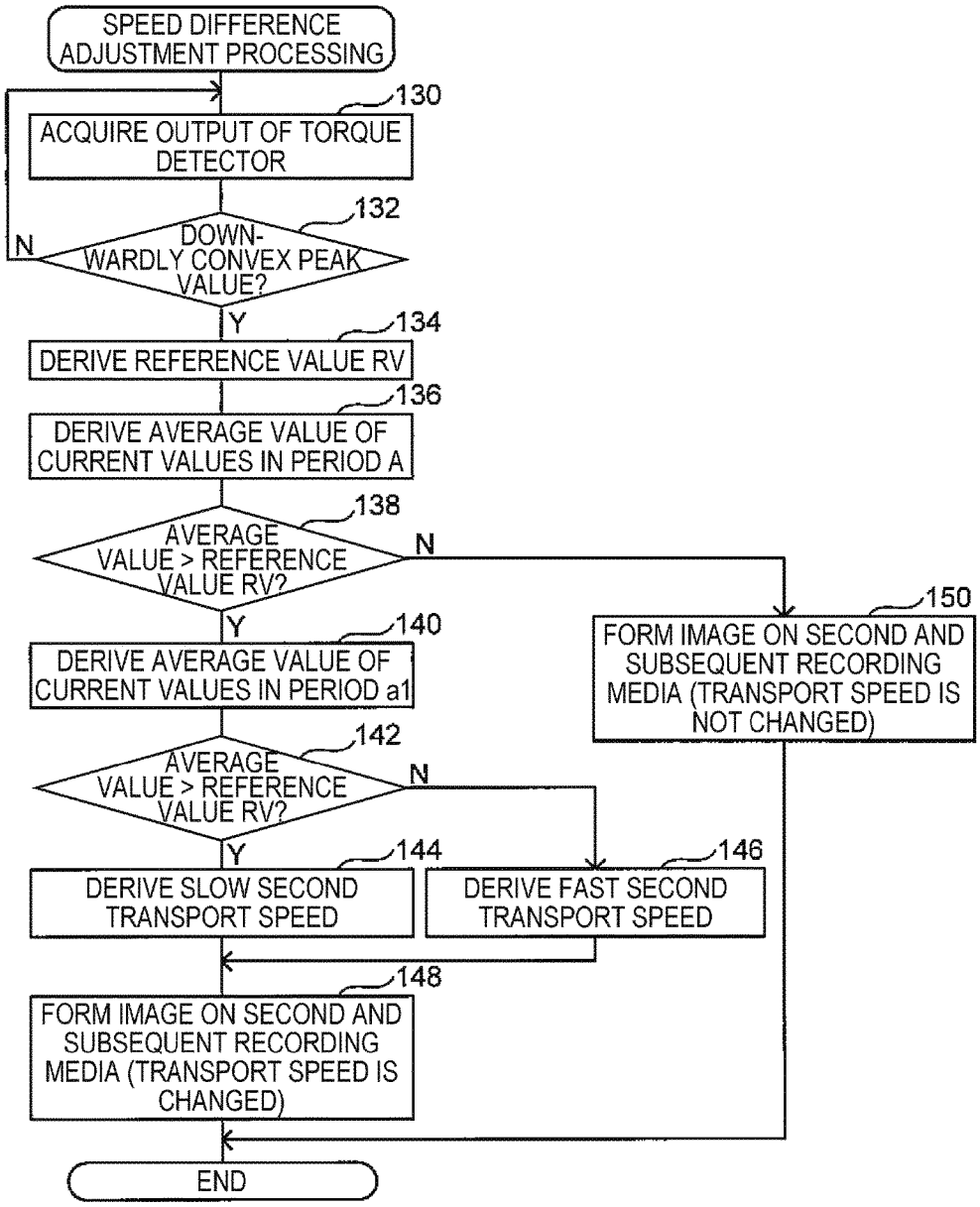
FIG. 7 is a flowchart illustrating the flow of a processing of a speed-difference adjustment processing program according to an exemplary embodiment.

Subsequently, the action of the image forming apparatus 10 according to the present exemplary embodiment will be described with reference to FIG. 7. Here, FIG. 7 is a flowchart illustrating the flow of a processing of a speed-difference adjustment processing program to be executed by the CPU 100. This speed-difference adjustment processing program is executed, for example, when a formation instruction of forming an image on each of plural recording media P is input and the medium detection sensor 82 detects that the leading end portion of the first recording medium P passes a detection position. In addition, this speed-difference adjustment processing program is previously installed in the ROM 102. In addition, here, in order to avoid confusion, it is assumed that the size of the recording medium P, which is an image forming target, is input along with the formation instruction. In addition, here, in order to avoid confusion, a description related to a processing of forming an image on the recording medium P will be omitted.

In step 130 of FIG. 7, the CPU 100 acquires a current value output from the torque detector 124. In the next step 132, the CPU 100 determines whether or not the current value acquired in previous step 130 is a downwardly convex peak value. Specifically, as an example, when the current value acquired in step 130 is equal to or less than a predetermined threshold value, the CPU 100 determines that the current value is a downwardly convex peak value. As the threshold value of this case, for example, a value, which has been previously acquired as the upper limit value of the downwardly convex peak value through, for example, a test using an actual appliance of the image forming apparatus 10, may be applied. When a negative determination is made, the CPU 100 returns to step 130, but when a positive determination is made, the CPU 100 proceeds to step 134.

In addition, in the present exemplary embodiment, the acquisition processing of the current value output from the torque detector 124 in step 130 is adapted to acquire the current value at a predetermined acquisition interval (sampling rate) (an interval of 10 ms in the present exemplary embodiment).

In step 134, the CPU 100 derives the average value of the current values in the period B in the time series data of the current values acquired by the repetitive processing of step 130, as the reference value RV. In the next step 136, the CPU 100 derives the average value of the current values in the period A in the time series data of the current values acquired by the repetitive processing of step 130.

In the next step 138, the CPU 100 determines whether or not the average value derived in step 136 is larger than the reference value RV derived in step 134. When a negative determination is made, the CPU 100 proceeds to step 150, and when a positive determination is made, the CPU 100 proceeds to step 140. In addition, in this step 138, the CPU 100 may determine whether or not the average value derived in step 136 is larger than a value, which is acquired by adding a predetermined margin to the reference value RV derived in step 134.

In step 140, the CPU 100 derives the average value of the current values in the period a1 in the time series data of the current values acquired by the repetitive processing of step 130. In step 142, the CPU 100 determines whether or not the average value derived in step 140 is larger than the reference value RV derived in step 134. When a negative determination is made, the CPU 100 proceeds to step 146, and when a positive judgment is made, the CPU 100 proceeds to step 144. In addition, in this step 142, the CPU 100 may determine whether or not the average value derived in step 140 is larger than a value, which is acquired by adding a predetermined margin to the reference value RV derived in step 134.

In step 144, as described above, based on Table 1, the CPU 100 derives the second transport speed, which is made slower as the length of the recording medium P in the transport direction increases and the average value of the current values in the period A derived in step 136 increases.

Meanwhile, in step 146, the CPU 100 derives the average value of the current values in the period a2 n the time series data of the current values acquired by the repetitive processing of step 130. In addition, as described above, based on Table 1, the CPU 100 derives the second transport speed, which is made faster as the length of the recording medium P in the transport direction increases and the derived average value of the current values in the period a2 increases.

In step 148, the CPU 100 performs control to change the second transport speed into the second transport speed derived in step 144 or step 146, performs a control to form an image on the second and subsequent recording media P, and thereafter terminates this speed-difference adjustment processing.

Meanwhile, in step 150, the CPU 100 performs control to form an image on the second and subsequent recording media P without changing the transport speed of the recording medium P, and thereafter terminates this speed-difference adjustment processing.

Meanwhile, the present exemplary embodiment has been described with reference to the case of using the IH type fixing device, but is not limited thereto. For example, a fixing device of another type using a halogen lamp or the like may be used.

In addition, the exemplary embodiment has been described with reference to the case of adjusting the second transport speed when the speed difference between the first transport speed and the second transport speed is adjusted, but is not limited thereto. For example, the first transport speed may be adjusted, and both the first transport speed and the second transport speed may be adjusted.

In the case of adjusting the first transport speed, for example, when the average value of the current values in the period A and the average value of the current values in the period a1 are larger than the reference value RV, there is illustrated an example in which the first transport speed is made faster as the average value of the current values in the period A increases. In addition, in the case of adjusting the first transport speed, for example, when the average value of the current values in the period A is larger than the reference value RV and the current value in the period a1 is equal to or less than the reference value RV, there is illustrated an example in which the first transport speed is made slower as the average value of the current values in the period a2 is increases.

In addition, in the case of adjusting both the first transport speed and the second transport speed, for example, when the average value of the current values in the period A and the average value of the current values in the period a1 are larger than the reference value RV, there is illustrated an example in which the first transport speed is made faster and the second transport speed is made faster as the average value of the current values in the period A increases. In addition, in this case, there is illustrated an example in which both the first transport speed and the second transport speed are adjusted so that the speed difference after the first transport speed and the second transport speed are adjusted is equal to the speed difference after the second transport speed is adjusted in the exemplary embodiment.

In addition, in the case of adjusting both the first transport speed and the second transport speed, for example, when the average value of the current values in the period A is larger than the reference value RV and the average value of the current values in the period a1 is equal to or less than the reference value RV, there is illustrated an example in which the first transport speed is made slower and the second transport speed is made faster as the average value of the current values in the period a2 increases. In addition, in this case, there is illustrated an example in which both the first transport speed and the second transport speed are adjusted so that the speed difference after the first transport speed and the second transport speed are adjusted is equal to the speed difference after the second transport speed is adjusted in the exemplary embodiment.

In addition, in the case of adjusting the first transport speed, there is illustrated an example in which the transport speed of the recording medium P by the separation roller 66, the registration roller 68 and the like is a1 so adjusted to the adjusted first transport speed. In addition, in this case, there is further illustrated an example in which the transfer speed of a toner image to the intermediate transfer belt 42 by the image forming unit 16, the primary transfer unit 18, and the like is also adjusted.

In addition, the exemplary embodiment has been made with reference to the case where a determination as to whether or not a current value is the peak value is made by a comparison between the current value and a threshold value, but is not limited thereto. For example, a determination as to whether or riot a current value is the peak value may be made by a comparison between a value obtained by integrating the current values with a predetermined period, a moving average value of the current values, or the like and the threshold value.

In addition, the exemplary embodiment has been described with reference to the case where the speed-difference adjustment processing program is previously installed in the ROM 102 has been described, but is not limited thereto. For example, the speed-difference adjustment processing program may be in the form of being provided by being stored in a storage medium such as a compact disc read only memory (CD-ROM), or in the form of being provided via a network.

In addition, the exemplary embodiment has been described with reference to the case where the speed-difference adjustment processing is realized by a software configuration using a computer by executing a program has been described, but is not limited thereto. For example, the speed-difference adjustment processing may be realized by a hardware configuration, or the combination of a hardware configuration and a software configuration.

In addition, the configuration of the image forming apparatus 10 (see FIGS. 1 and 2) described in the exemplary embodiment is art example, and of course, unnecessary parts may be deleted or a new part may be added within the range not deviating from the gist of the invention.

In addition, the flow of a processing of the speed-difference adjustment processing program (see FIG. 7) described in the exemplary embodiment is an example, and of course, an unnecessary step may be omitted, a new step may be added, or the processing sequence may be changed without departing from the gist of the invention.

The foregoing description of the exemplary embodiments of the invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a transport unit configured to pinch and transport a recording medium at a first transport speed;

a fixing unit configured to fix an image formed on the recording medium while pinching and transporting the recording medium, which is transported by the transport unit, at a second transport speed;

a driving unit configured to drive the fixing unit;

a detector configured to detect a load of the driving unit; and a controller configured to perform a control to adjust a speed difference between the first transport speed and the second transport speed with respect to a subsequently transported recording medium in response to the load becoming larger than a reference value after a peak value of the load when the recording medium enters the fixing unit is detected by the detector.

2. The image forming apparatus according to claim 1, wherein the controller is configured to perform at least one of (i) a control to make the first transport speed faster than a current first transport speed and (ii) a control to make the second transport speed slower than a current second transport speed in response to the load becoming larger than the reference value before a predetermined period has elapsed from a time when the peak value is detected.

3. The image forming apparatus according to claim 2, wherein the controller is configured to, when performing the control to make the first transport speed faster than the current first transport speed, increase a degree of making the first transport speed faster as the load increases, and wherein the controller is configured to, when performing the control to make the second transport speed slower than the current second transport speed, increase a degree of making the second transport speed slower as the load increases.

4. The image forming apparatus according to claim 3, wherein the reference value is an average value of the load detected by the detector in a period from when the recording medium is discharged by the transport unit to when the recording medium is discharged by the fixing unit.

5. The image forming apparatus according to claim 2, wherein the reference value is an average value of the load detected by the detector in a period from when the recording medium is discharged by the transport unit to when the recording medium is discharged by the fixing unit.

6. The image forming apparatus according to claim 1, wherein the controller is configured to, in response to the load becoming larger than the reference value after a predetermined period has elapsed from a time when the peak value is detected, perform at least one of (i) a control to make the first transport speed slower than a current first transport speed and (ii) a control to make the second transport speed faster than a current second transport speed.

7. The image forming apparatus according to claim 6, wherein the controller is configured to, when performing the control to make the first transport speed slower than the current first transport speed, increase a degree of making the first transport speed slower as the load increases, and wherein the controller is configured to, when performing the control to make the second transport speed faster than the current second transport speed, increase a degree of making the second transport speed faster as the load increases.

8. The image forming apparatus according to claim 7, wherein the reference value is an average value of the load detected by the detector in a period from when the recording medium is discharged by the transport unit to when the recording medium is discharged by the fixing unit.

9. The image forming apparatus according to claim 6, wherein the reference value is an average value of the load detected by the detector in a period from when the recording medium is discharged by the transport unit to when the recording medium is discharged by the fixing unit.

10. The image forming apparatus according to claim 1, wherein the reference value is an average value of the load detected by the detector in a period from when the recording medium is discharged by the transport unit to when the recording medium is discharged by the fixing unit.

11. The image forming apparatus according to claim 1, wherein the controller is configured to, when performing the control to adjust the speed difference, perform a control to adjust the second transport speed among the first transport speed and the second transport speed.

12. A recording medium transport apparatus comprising:

a first transport unit configured to pinch and transport a recording medium at a first transport speed;

a second transport unit configured to pinch and transport the recording medium, which is transported by the first transport unit, at a second transport speed;

a driving unit configured to drive the second transport unit;

a detector configured to detect a load of the driving unit; and a controller configured to perform a control to adjust a speed difference between the first transport speed and the second transport speed with respect to a subsequently transported recording medium in response to the load becoming larger than a reference value after a peak value of the load when the recording medium enters the second transport unit is detected by the detector.

13. The recording medium transport apparatus according to claim 12, wherein the controller is configured to perform at least one of (i) a control to make the first transport speed faster than a current first transport speed and (ii) a control to make the second transport speed slower than a current second transport speed in response to the load becoming larger than the reference value before a predetermined period has elapsed from a time when the peak value is detected.

14. The recording medium transport apparatus according to claim 12, wherein the controller is configured to, when performing the control to make the first transport speed faster than the current first transport speed, increase a degree of making the first transport speed faster as the load increases, and wherein the controller is configured to, when performing the control to make the second transport speed slower than the current second transport speed, increase a degree of making the second transport speed slower as the load increases.

15. The recording medium transport apparatus according to claim 12, wherein the controller is configured to, in response to the load becoming larger than the reference value after a predetermined period has elapsed from a time when the peak value is detected, perform at least one of (i) a control to make the first transport speed slower than a current first transport speed and (ii) a control to make the second transport speed faster than a current second transport speed.

16. The recording medium transport apparatus according to claim 15, wherein the controller is configured to, when performing the control to make the first transport speed slower than the current first transport speed, increase a degree of making the first transport speed slower as the load increases, and wherein the controller is configured to, when performing the control to make the second transport speed faster than the current second transport speed, increase a degree of making the second transport speed faster as the load increases.

17. The recording medium transport apparatus according to claim 12, wherein the reference value is an average value of the load detected by the detector in a period from when the recording medium is discharged by the first transport unit to when the recording medium is discharged by the second transport unit.

* * * * *